US007084865B2

(12) United States Patent
Tyrrell et al.

(10) Patent No.: US 7,084,865 B2
(45) Date of Patent: Aug. 1, 2006

(54) POWER SAVING IN MONOCHROME LCD DISPLAY DRIVER IC'S BY ELIMINATING EXTRANEOUS SWITCHING

(75) Inventors: Julian Tyrrell, Swindon (GB); Dave Clewett, Wootton Bassett (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 270 days.

(21) Appl. No.: 10/295,155

(22) Filed: Nov. 15, 2002

(65) Prior Publication Data

US 2004/0095302 A1 May 20, 2004

(30) Foreign Application Priority Data

Jul. 11, 2002 (EP) ..... 02392017

(51) Int. Cl.
*G09G 5/00* (2006.01)

(52) U.S. Cl. ..... 345/211

(58) Field of Classification Search ..... 345/102, 345/600, 147–154, 520, 564, 565, 507, 516, 345/556, 85–101; 348/441, 443; 358/1.9; 382/159, 166; 380/226; 711/211
See application file for complete search history.

(56) References Cited

U.S. PATENT DOCUMENTS 4,471,379 A * 9/1984 Stephens ..... 380/226
4,604,617 A 8/1986 Morozumi ..... 340/805
5,231,663 A * 7/1993 Earl et al. ..... 382/159
5,526,025 A * 6/1996 Selwan et al. ..... 345/556
5,712,999 A * 1/1998 Guttag et al. ..... 711/211
5,790,096 A * 8/1998 Hill, Jr. ..... 345/600
5,825,343 A 10/1998 Moon ..... 345/94
5,986,631 A 11/1999 Nanno et al. ..... 345/94
6,037,919 A 3/2000 Hanson ..... 345/87
6,075,509 A * 6/2000 Ellis et al. ..... 345/98
6,127,994 A * 10/2000 Ellis et al. ..... 345/94
6,188,378 B1 * 2/2001 Yamamoto et al. ..... 345/101
6,232,944 B1 5/2001 Kamagawa et al. ..... 345/98
6,259,810 B1 * 7/2001 Gill et al. ..... 382/166
6,348,910 B1 * 2/2002 Yamamoto et al. ..... 345/102
6,690,344 B1 * 2/2004 Takeuchi et al. ..... 345/85
2002/0057238 A1 * 5/2002 Nitta et al. ..... 345/87
2002/0080109 A1 * 6/2002 Nagata et al. ..... 345/92
2002/0101396 A1 * 8/2002 Huston et al. ..... 345/87
2003/0107753 A1 * 6/2003 Sakamoto ..... 358/1.9
2003/0184593 A1 * 10/2003 Dunlop ..... 345/810
2004/0066363 A1 * 4/2004 Yamano et al. ..... 345/98
2004/0095302 A1 * 5/2004 Tyrrell et al. ..... 345/87

FOREIGN PATENT DOCUMENTS

WO WO98/44480 10/1998

* cited by examiner

*Primary Examiner*—Bipin Shalwala
*Assistant Examiner*—Prabodh Dharia
(74) *Attorney, Agent, or Firm*—Saile Ackerman LLC; Stephen G. Ackerman

(57) ABSTRACT

A method and a system to reduce the power consumption of a LCD driver have been achieved. In order to save power a logic circuitry is connected to the output of a RAM automatically comparing displayed data on a line by line during the scan and, on detection of no data change, keeping the output pins static. In the case a COMMON row contains zero data only the corresponding common output is not selected and does not switch the display and hence saves the charging current for said row of data. This logic circuit is an extension to standard prior art circuitry controlling a LCD display.

14 Claims, 4 Drawing Sheets

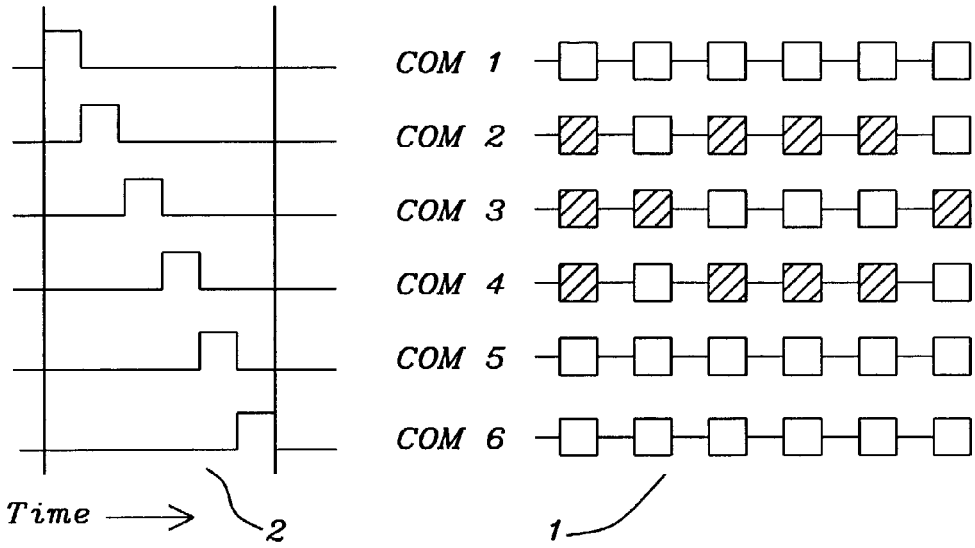
FIG. 1 – Prior Art
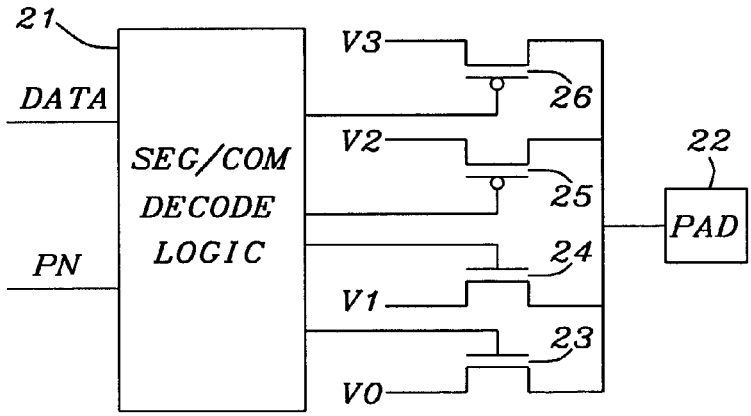
FIG. 2 – Prior Art

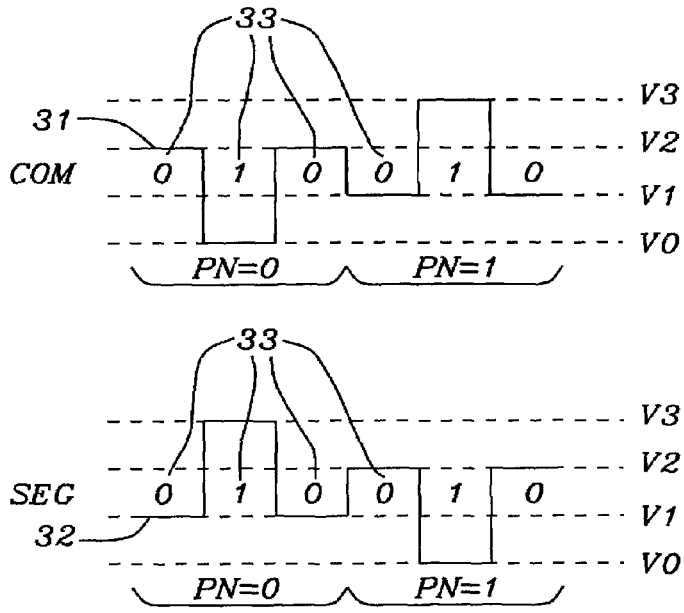
FIG. 3 – Prior Art
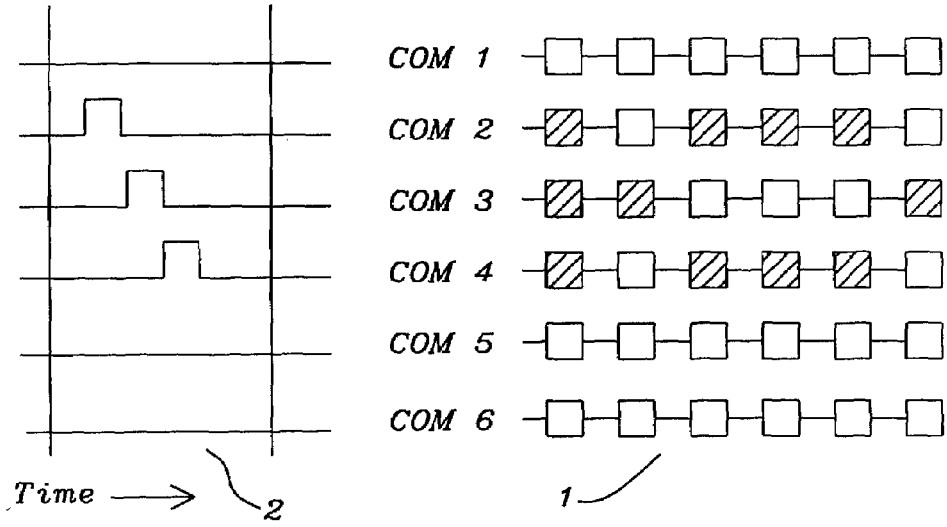
FIG. 4

POWER SAVING IN MONOCHROME LCD DISPLAY DRIVER IC'S BY ELIMINATING EXTRANEOUS SWITCHING

BACKGROUND OF THE INVENTION (1) Field of the Invention

This invention relates generally to Liquid Crystal Displays (LCD), and more particularly to a method and a circuit to reduce power consumption of a LCD driver IC.

(2) Description of the Prior Art

Liquid crystal displays (LCD) use nematic liquid crystals. The molecular order in a nematic liquid crystal, which results from weak intermolecular forces, is easily disrupted. For this reason, the liquid crystals flow like an ordinary liquid. Because of the weakness of the intermolecular forces, the molecules in a nematic phase are easily realigned along new directions.

A liquid crystal display uses this ease of molecular reorientation to change areas of the display from light to dark, resulting in patterns that you see in the display. The display consists of liquid crystals contained between glass plates whose interior surfaces are treated to align the molecules in a given direction. When the voltage to a set of electrodes in some area of the display is turned on, the molecules of the liquid crystal in that area reorient along a new direction. When this voltage is turned off, the molecules return to their original orientation.

LCD's require an AC drive voltage with virtually no DC component. Prolonged DC operation may cause electrochemical reactions inside the display, which will cause significantly reduced life. It is essential that the voltage wave-form across the glass plates of the display be maintained at an average DC value of zero because the glass is likely to suffer a break-down if a non-zero DC voltage is applied for any sustained period of time. There is threshold behaviour for most LCD's and no change in transmission occurs until a threshold voltage, Vth, is reached. Transmission then decreases as the voltage increases until saturation is reached. Threshold voltage is typical 1.5–2.5 volts, and saturation occurs at about 4–5 volts.

The pixels across each horizontal "common" row of a LCD are connected together on the plate on one side of the liquid crystal film, and all the pixels in each vertical "segment" column are connected on the opposite side. The "commons" are then addressed serially by setting all the column voltages separately for each "common" and then turning on the "common" voltages in sequence.

Principally LCD's require a differential voltage greater than the threshold voltage Vth of the nematic fluid between two conducting layers to generate an "ON" pixel. The display consists of a matrix of pixels created by vertical "segment" (SEG) and horizontal "common" (COM) conductive layer either side of the nematic fluid. The display has the electrical characteristics of a capacitor, so requiring a "charging" current every time a "segment" and/or "common" are switched.

In order to display a whole picture the "commons" are scanned in sequence and the segments switched appropriately. This is done so that the applied root-mean-square (RMS) voltage between each common and segment is controlled to be greater ("ON") or less than ("OFF") the threshold voltage Vth of the display.

The data for the display is contained in a random access memory (RAM), which is typically structured to be the same as the display. For example, a display of 80 segments and 64 commons would have a RAM of 80 by 64 bits. The display scan reads a row of the RAM for each active common output.

Currently available driver IC's continually switch the LCD regardless of the displayed data. This causes a switching waveform, and hence power supply current, to be required through the whole display. This causes power consumption even if there is no change of data.

FIG. 1 prior art shows a simple display comprising 6 segments and 6 commons. The waveforms 2 show the sequencing of the commons over time during a display scan. The matrix 1 on the right shows the 36 pixels. The black rectangles represent "ON" pixels, the white rectangles represent "OFF" pixels. All the 6 commons are selected, independent if all pixels in a row are "OFF" or not. In the example of FIG. 1 prior art e.g. the rows 1, 5 and 6 are blank, this means all pixels are "OFF". Nevertheless all commons got selected for sequencing of the pulses 2.

FIG. 2 prior art shows a basic circuit of a typical COM/SEG decode logic-generating signals to the pad control circuitry 22. Pad refers to the input to the LCD glass. The input to said SEG/COM decode logic 21 is data read out from a RAM and the PN signal. PN (Positive/Negative) refers to a signal to change the polarity between the Common and the Segment pad and is switching regularly between "0" and "1" to ensure that an average DC value of zero is achieved. The output of said SEG/COM decode logic 21 activates one of symmetric voltages V0–V3. Four transistors 23, 24, 25 and 26 perform the switching. The signal generated is linked to the related pad providing input to the LCD glass.

The following table shows related decode logic of said driver 21. The table shows which one of the four output voltages V0 to V3 is applied depending on the input values of data and PN:

| DATA | PN | SEG | COM |
|---|---|---|---|
| 0 | 0 | V1 | V2 |
| 1 | 0 | V3 | V0 |
| 0 | 1 | V2 | V1 |
| 1 | 1 | V0 | V3 |

For example, if the data is "1" either SEG or COM is at the maximum voltage V3, dependent on the value of the polarity signal PN and the related pixel is "lit".

As another example of a typical implementation FIG. 3 prior art shows the COM and SEG voltage waveforms for a simple Super Twisted Nematic (STN) LCD display; where the outputs switch one of four symmetric voltages as it has been shown by FIG. 2 prior art. The curve 31 shows the waveform of the COMMON voltage, the curve 32 shows the waveform of the SEGMENT voltage. The related pixels 33 are lit ("1") if either the COM signal or the SEG signal is at the maximum value V3.

U.S. patent (U.S. Pat. No. 5,825,343 to Moon) describes a driving device and a method of driving a TFT-LCD using a two-pulse electrode voltage to thereby double the duration of the driving impulse. The driving device includes a liquid crystal interface IC that outputs a two-pulse start signal and a clock signal. A gate bus driver IC outputs a two-pulse gate electrode voltage to each gate line according to the start signal inputted from the liquid crystal interface IC and a liquid crystal pixel is driven by the difference in potential between a grey voltage and a common electrode voltage.

U.S. patent (U.S. Pat. No. 5,986,631 to Nanno et al.) discloses a driving method of an active matrix LCD. According to this method, a scan signal has three voltages levels, i.e., an ON voltage, an OFF voltage and a compensation voltage having the opposite polarity with respect to the OFF voltage. In contrast with the conventional capacitively coupled driving method in which the scan signal consists of four voltages, the driving method of this invention can reduce a cost and power consumption for a driver IC without degradation due to flickers or other causes.

U.S. patent (U.S. Pat. No. 6,232,944 to Kumagawa et al.) shows a compact and inexpensive LCD by improving a drive method for compensating a cross-talk using a compensating pulse added to a signal voltage so that a drive IC and a periphery of the LCD panel are reduced in size. Only one of positive and negative compensating pulses is added in accordance with a predetermined period. The compensating pulse preferably has a waveform including low frequency components. A width or a height of the compensating pulse varies in accordance with a location of the signal electrode, display pattern or other factors.

SUMMARY OF THE INVENTION

The principal object of the present invention is to reduce the power consumption of a LCD driver IC.

In accordance with the objects of this invention a method to reduce the current consumption of a LCD driver IC by avoiding COMMON output to LCD rows having all blanks has been achieved. Said method comprises first providing a display data RAM, a means to detect an all-zero condition in a COMMON row, a SEGMENT decode block, SEGMENT pads, COMMON pads, a COMMON decode block, a COMMON logic block and a control logic block. The steps of said method are to select a COMMON row number according to any defined sequence, to read COMMON rows selected from RAM, to check if the data of COMMON row selected row contains all zeros, if the data of selected COMMON row is all zero, to go back to read next the COMMON row, or if the data of selected row number is not all zero switch common row selected and go back to read next COMMON ROW.

In accordance with the objects of this invention a system to reduce the power consumption of a LCD driver IC by avoiding COMMON output to LCD rows having all blanks is achieved. Said system comprises first a display data RAM containing the data to be displayed on a LCD being controlled by a control logic block and providing output to a means of detecting an all-zero condition in a COMMON row selected, a control logic block controlling the overall display of the data stored in said display data RAM and a means to detect an all-zero condition in a COMMON row selected by said control logic block providing information to a COMMON logic block and a to a SEGMENT decode block. Furthermore said system comprises a COMMON logic block having an input and an output wherein said input is from said means to detect an all-zero condition and from said control logic block and the output is controlling a COMMON decode block, a COMMON decode block receiving signals from said COMMON logic block and providing signals to COMMON pads, a SEGMENT decode block receiving signals from said means to detect an all-zero condition and providing signals to SEGMENT pads. Finally said system comprises SEGMENTS pads to control the SEGMENTS of a LCD-display and COMMON pads to control the COMMONS of a LCD display.

BRIEF DESCRIPTION OF THE DRAWINGS

In the accompanying drawings forming a material part of this description, there is shown:

FIG. 1 prior art illustrates a simple 6 segment and 6 common display with a displayed picture including waveforms showing the sequencing of the commons during a display scan.

FIG. 2 prior art shows a circuit of a typical COM/SEG decode logic-generating signals to the pad control circuitry.

FIG. 3 prior art shows the COM and SEG voltage waveforms for a simple Super Twisted Nematic (STN) LCD display.

FIG. 4 illustrates a simple 6 segment and 6 common display with a displayed picture including waveforms showing the invented sequencing of the commons during a display scan.

DESCRIPTION OF THE PREFERRED EMBODIMENTS

Figure 5:
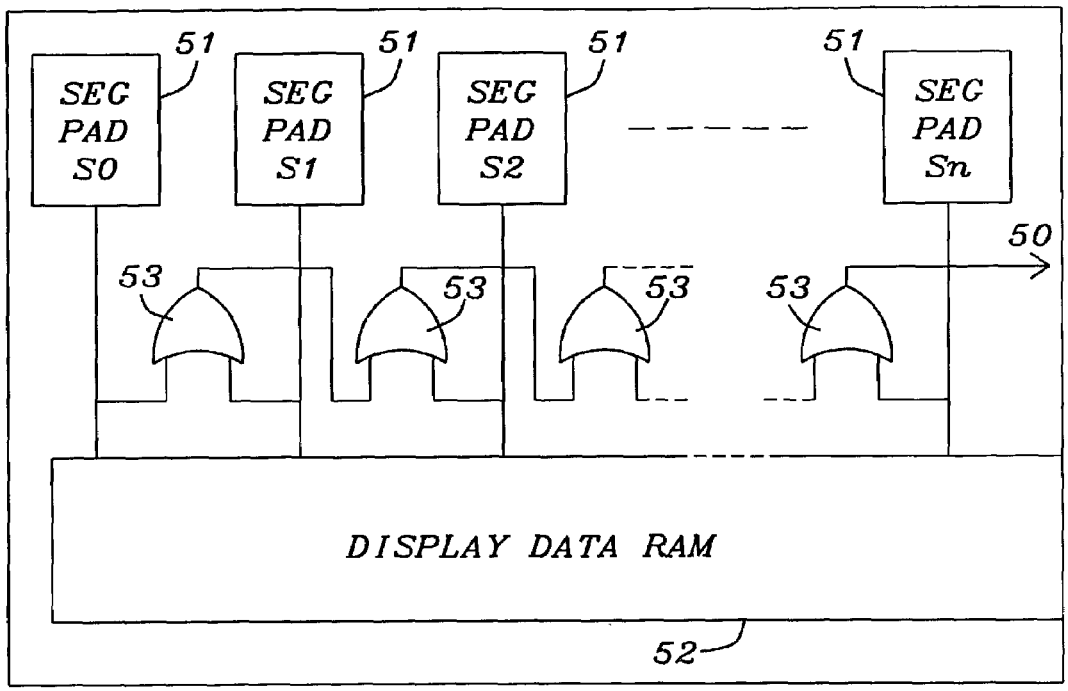
FIG. 5 shows the segment pad structure and the invented "ALL-ZERO" data detection.

The preferred embodiments disclose a method and a circuit to reduce the power consumption of an LCD driver IC.

In prior art available driver IC's continually switch the LCD regardless of the displayed data. FIG. 1 prior art shows that, although all pixels in some rows were "OFF", corresponding common output in said rows was selected. In order to save power consumption in the LCD driver IC, logic circuitry between the RAM and the segment output detects if the data for the selected row is all zero's (implying that all pixels are off).

In case if the data of a row are all zero's the corresponding common output is not selected. This leaves all of the driver pins at the "OFF" state and does not switch the display and hence does not charge/discharge the capacitance of the display. This technique will automatically reduce the driver pins switching when the LCD is used in a partial mode, i.e. where one part or several parts contain one or more blank rows. However the scan rate of the display remains constant and this maintains the correct RMS voltage applied for the "ON" pixels.

FIG. 4 shows an example display comprising 6 segments and 6 commons. The same configuration has been selected as in FIG. 1 prior art. The waveforms 2 show the sequencing of the commons over time during a display scan. The matrix 1 on the right shows 36 pixels. The black rectangles represent "ON" pixels, the white rectangles represent "OFF" pixels. Only a few pixels are "lit". In this case the first and the last two common lines (COM1, COM5 and COM6) will not be switched as the RAM contains all zero data for these lines and hence all segments are off. Contrary to prior art the common pins of said blank commons were not switched, hence reducing the power consumption of the LCD driver IC.

As an example of the constant frame rate achieved: a 80 by 64 display has just the central 35 lines containing data, say from 20 to 54 inclusive. The scan starts at line COM1 and detects all zeros contained in the RAM so the common 1 output is NOT selected. This also occurs for lines 2 to 19 inclusive. Lines 20 to 54 are driven as normal as each line contains data. Lines 55 to 64 are also not selected, as these contain no data. The frame rate remains the time taken to complete the 64 line scan, thus giving the same RMS drive voltage regardless of the number of lines containing data.

The segment pad structure and "ALL-ZERO" detection of the invention presented is showed in FIG. 5. The LCD display data held in the RAM 52 drives the SEG pads 51 ranging from segment zero to segment n. The RAM outputs are logically OR'd by the OR gates 53 together to produce an output signal 50 that indicates 'non-zero' data. When this signal is "1" the related COM output has to be activated, when this signal is "0", no COM output is activated as explained in FIG. 4.

Figure 6:
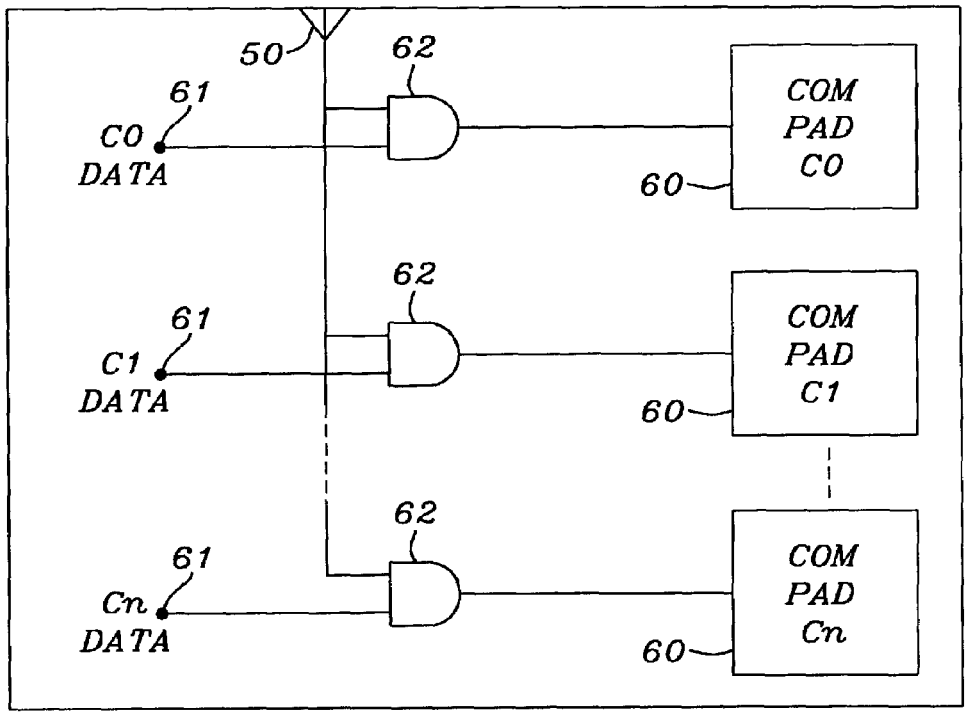
FIG. 6 shows the COM pad structure including the "blanking" invented

FIG. 6 shows the COM pad structure supporting the "blanking" invented. The common signals are generated by the RAM address logic, which selects the relevant COM pad 60 corresponding to the row of data 61 in the RAM. The signal from the control logic is logically AND'd by the AND gates 62 with the "non-zero" signal 50, shown in FIG. 5, to switch the corresponding COM pad. If said signal 50 is zero, the corresponding COM pad is not switched, all of the driver pins are left in the "OFF" state and hence the capacitance of the display are not being charged/discharged.

Figure 7:
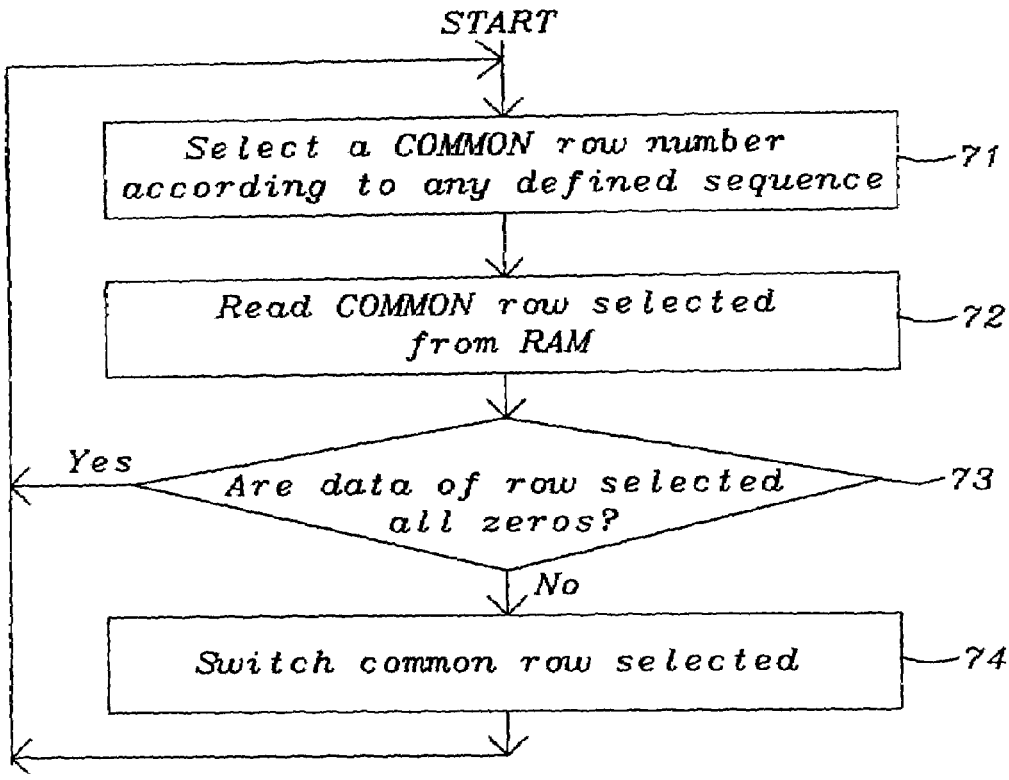
FIG. 7 shows a flowchart of the method illustrating how on detection of no data change the output pins were kept static.

FIG. 7 describes the logical sequence of the method how to reduce the operating power supply current of the LCD driver IC. Step 71 describes that a COMMON row is selected according to any defined sequence. Step 72 describes how the display scan sequentially reads the selected row of the RAM. Step 73 describes how a logic circuitry checks if the data in the selected row is all zero. If the data is all zeros than no pulse is sent to the selected common and the next row in the defined sequence is selected to be read. If at least one of the data is "ON" than the normal process is performed. This means, as described in step 74, the selected common is switched and the process is repeated by selecting and reading the next common row.

Figure 8:
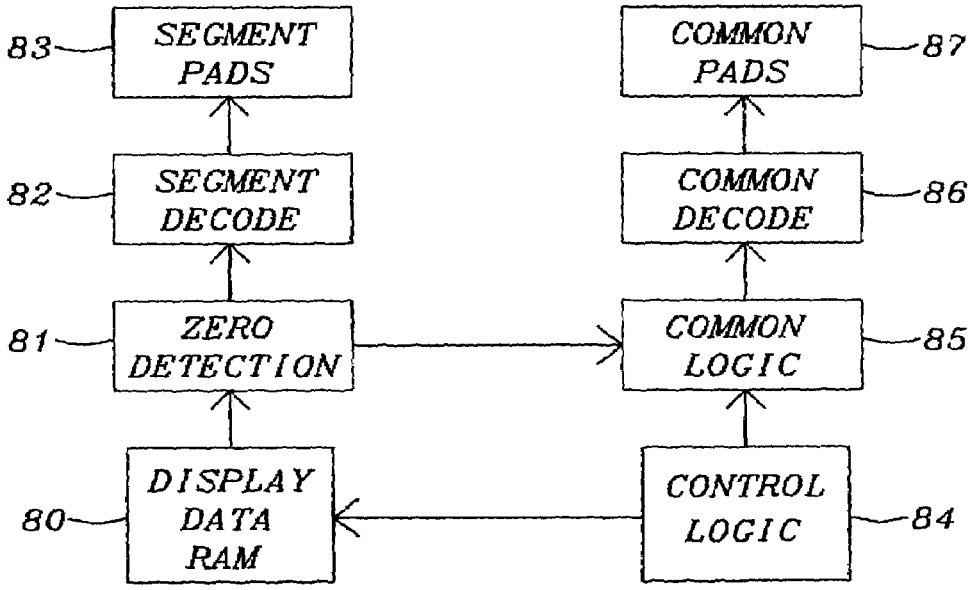
FIG. 8 shows a block diagram of the system invented

FIG. 8 describes the architecture of the system invented. A control logic block 84 is controlling the overall display of the data stored in the display data RAM 80. A logic circuitry 81 is connected to said RAM 80, to a segment decode block 82 and to a logic circuit block 85. Said logic circuitry 81 detects if the data for a selected row is all zero's. Said logic circuit block 85 is controlling the output to the COMMON rows. Said COMMON logic block 85 is receiving signals from the zero detection block 81 indicating "non-zero" data in a selected COMMON row. Additionally said COMMON logic block is controlled by said control logic block 84. A COMMON decode block 86 is receiving signals from said COMMON logic block 85 and is providing the signals to the COMMON pads.87. A SEGMENT decode block 82 is receiving signals from said zero detection block 81 and is providing the signals to the SEGMENT pads 83.

While the invention has been particularly shown and described with reference to the preferred embodiments thereof, it will be understood by those skilled in the art that various changes in form and details may be made without departing from the spirit and scope of the invention.

What is claimed is:

1. A method to reduce the current consumption of a LCD driver IC by avoiding COMMON output to LCD rows having all blanks comprising:

providing a display data RAM, a means to detect an all-zero condition in a COMMON row, a SEGMENT decode block, SEGMENT pads, COMMON pads, a COMMON decode block, a COMMON logic block and a control logic block;

select a COMMON row number according to any defined sequence;

read COMMON row selected from RAM;

check if the data of COMMON row selected row contains all zeros;

if the data of selected COMMON row is all zero, go back to read next

COMMON row; and if the data of selected row number is not all zero switch common row selected and go back to read next COMMON ROW.

2. The method of claim 1 wherein said means to detect an all-zero condition in a COMMON row comprises a logical operation comparing all values of data of the COMMON row selected.

3. The method of claim 2 wherein said logical operation is comprising logical OR-gates for all SEGMENTS of said COMMON row performing a logical OR-operation comprising the RAM output of all SEGMENTS of the COMMON row selected and is producing a signal indicating if a row selected contains all zero data or not.

4. The method of claim 1 wherein said COMMON logic block switches a COMMON pad according to the result of a logical operation involving a signal indicating if any data in said COMMON row is non-zero.

5. The method of claim 4 wherein said logical operation is comprising a logical AND-operation involving a signal indicating if any data in said COMMON row is non-zero and the data of the corresponding row.

6. The method of claim 1 wherein said defined sequence to read the COMMON rows is from COMMON row 1 to the last row and then said sequence is repeated continuously.

7. The method of claim 1 wherein said control logic block is selecting the relevant COMMON pad corresponding to the row of data in the RAM.

8. A system to reduce the power consumption of a LCD driver IC by avoiding COMMON output to LCD rows having all blanks comprising:

a display data RAM containing the data to be displayed on a LCD being controlled by a control logic block and providing output to a means of detecting an all-zero condition in a COMMON row selected;

a control logic block controlling the overall display of the data stored in said display data RAM;

a means to detect an all-zero condition in a COMMON row selected by said control logic block providing information to a COMMON logic block and a SEGMENT decode block;

a COMMON logic block having an input and an output wherein said input is from said means to detect an all-zero condition and from said control logic block and the output is controlling a COMMON decode block;

a COMMON decode block receiving signals from said COMMON logic is block and providing signals to COMMON pads;

a SEGMENT decode block receiving signals from said means to detect an all-zero condition and providing signals to SEGMENT pads;

SEGMENTS pads to control the SEGMENTS of a LCD-display, and

COMMON pads to control the COMMONS of a LCD display.

9. The system of claim 8 wherein said means to detect an all-zero condition in a COMMON row is comprising logical gates comparing all values of data of the COMMON row selected.

10. The system of claim 9 wherein said logical gates are logical OR-gates for all SEGMENTS of said COMMON row performing a logical OR-operation comprising said display data RAM output of all SEGMENTS of the COMMON row selected and providing a signal indicating if a row selected contains all zero data or not.

11. The system of claim 8 wherein said COMMON logic block switches a COMMON pad according to the result of a logical operation involving a signal indicating if any data in said COMMON row is non-zero and the data of the corresponding row.

12. The system of claim 11 wherein said logical operation is comprising a logical AND-operation involving a signal indicating if any data in said COMMON row is non-zero and the data of the corresponding row.

13. The method of claim 1 wherein the scan rate of said of said display driver remains constant.

14. The system of claim 8 wherein the scan rate of said of said display driver remains constant.

* * * * *